US010247203B2

(12) United States Patent
Ono et al.

(10) Patent No.: US 10,247,203 B2
(45) Date of Patent: Apr. 2, 2019

(54) NOISE REDUCTION STRUCTURE AND SUPERCHARGING DEVICE

(71) Applicant: MITSUBISHI HEAVY INDUSTRIES, LTD., Tokyo (JP)

(72) Inventors: Yushi Ono, Nagasaki (JP); Hiroyuki Hosoya, Tokyo (JP); Kentaro Hayashi, Tokyo (JP); Seokcheol Kim, Nagasaki (JP); Yoshihisa Ono, Nagasaki (JP); Yasuhiro Wada, Nagasaki (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/748,361

(22) PCT Filed: Jan. 11, 2017

(86) PCT No.: PCT/JP2017/000532
§ 371 (c)(1),
(2) Date: Jan. 29, 2018

(87) PCT Pub. No.: WO2017/145536
PCT Pub. Date: Aug. 31, 2017

(65) Prior Publication Data

US 2018/0223873 A1 Aug. 9, 2018

(30) Foreign Application Priority Data

Feb. 22, 2016 (JP) ..... 2016-031340

(51) Int. Cl.
*F04D 29/66* (2006.01)
*F04D 29/42* (2006.01)
(Continued)

(52) U.S. Cl.
CPC ..... *F04D 29/665* (2013.01); *F04D 25/024* (2013.01); *F04D 29/4206* (2013.01); *F04D 29/5826* (2013.01); *F05D 2250/52* (2013.01)

(58) Field of Classification Search
CPC ..... F04D 29/665; F04D 29/66; F04D 29/663; F04D 29/4206; F04D 29/5826;
(Continued)

(56) References Cited

U.S. PATENT DOCUMENTS 2,225,398 A * 12/1940 Hamblin ..... F04D 29/665 181/257
3,174,682 A * 3/1965 Wilfert ..... B60H 1/00471 415/119
(Continued)

FOREIGN PATENT DOCUMENTS

EP 1 510 667 A2 3/2005
JP 62-45323 U 3/1987
(Continued)

OTHER PUBLICATIONS

International Search Report dated Mar. 14, 2017, issued in counterpart International Application No. PCT/JP2017/000532 (2 pages).
(Continued)

*Primary Examiner* — Carlos A Rivera
*Assistant Examiner* — Adam W Brown
(74) *Attorney, Agent, or Firm* — Westerman, Hattori, Daniels & Adrian, LLP

(57) ABSTRACT

A noise reduction structure includes a compressor discharge-side pipe portion, a first porous plate having a plurality of through holes and extending circumferentially along an inner circumferential surface of the compressor discharge-side pipe portion so that an air layer is formed between the first porous plate and the inner circumferential surface, a partition dividing an interior of the compressor discharge-
(Continued)

side pipe portion in a radial direction in a circumferential direction of the compressor discharge-side pipe portion so as to form a plurality of flow paths in the compressor discharge-side pipe portion, and a second porous plate having a plurality of through holes. The second porous plate is provided in each of the plurality of flow paths and extends along the partition so that an air layer is formed between the second porous plate and the partition.

8 Claims, 9 Drawing Sheets

(51) Int. Cl.
*F04D 25/02* (2006.01)
*F04D 29/58* (2006.01)

(58) Field of Classification Search
CPC .... F04D 25/024; F05D 2250/52; F01N 1/026; F01N 1/089
See application file for complete search history.

(56) References Cited

U.S. PATENT DOCUMENTS 3,312,389 A * 4/1967 Matsui ..... F04D 29/664 415/119
4,204,586 A * 5/1980 Hani ..... F04D 29/664 181/229
4,969,536 A * 11/1990 Allen ..... F02M 35/1216 181/225
6,382,931 B1 * 5/2002 Czabala ..... F04C 29/065 181/229
6,752,240 B1 * 6/2004 Schlagenhaft ..... F01N 1/02 181/247
6,896,095 B2 * 5/2005 Shah ..... F01P 5/06 181/198
7,017,706 B2 * 3/2006 Brown ..... F01D 25/30 181/222
7,722,316 B2 * 5/2010 Scarinci ..... F04D 29/663 415/119
8,651,800 B2 * 2/2014 Li ..... F02M 35/10157 415/119
9,057,313 B2 * 6/2015 Heeb ..... F01N 13/00
9,512,834 B2 * 12/2016 Streeter ..... F04C 29/061
9,726,198 B2 * 8/2017 Friedrich ..... F04D 29/422
2005/0150718 A1 * 7/2005 Knight ..... F01N 1/02 181/250
2010/0193282 A1 8/2010 Kim et al.
2015/0285269 A1 10/2015 Roberge et al.

FOREIGN PATENT DOCUMENTS

JP 2005-69228 A 3/2005
JP 2008-138687 A 6/2008
JP 2011-149380 A 8/2011
JP 4911783 B2 4/2012
JP 2012-517549 A 8/2012

OTHER PUBLICATIONS

Written Opinion dated Mar. 14, 2017, issued in counterpart International Application No. PCT/JP2017/000532, w/ English translation (5 pages).

* cited by examiner

NOISE REDUCTION STRUCTURE AND SUPERCHARGING DEVICE

TECHNICAL FIELD

The present invention relates to a noise reduction structure and a supercharging device.

BACKGROUND ART

A supercharger is widely used as an auxiliary device for obtaining high combustion energy in an internal combustion engine. For example, an exhaust turbine type supercharger is configured such that a compressor compresses air to be supplied to an internal combustion engine by driving a turbine connected coaxially with the compressor using exhaust gas of the internal combustion engine.

In recent year, there is a growing demand for reducing noise of a supercharger. Patent Document 1 discloses a silencer for reducing noise on an air discharge side of a compressor of a supercharger. This silencer includes a pipe connecting an outlet pipe of the compressor of the supercharger to an air cooler with a double pipe structure formed of an outer pipe and an inner pipe. Between the outer pipe and the inner pipe, a resonance cavity is defined, and the inner pipe is provided with a plurality of through holes communicating with the resonance cavity. It is disclosed that this structure allows the reduction of wind noise with a frequency corresponding to the rotational speed and the number of blades of a compressor impeller by setting the volume of the resonance cavity, as well as the cross-sectional area and the length of the through holes, in accordance with a resonance frequency corresponding to a blower rotational period.

CITATION LIST

Patent Literature

Patent Document 1: JP4911783B

SUMMARY

Problems to be Solved

The silencer disclosed in Patent Document 1 allows the noise reduction on an air discharge side of the supercharger, but the noise reduction effect tends to be restricted since a possible pipe length for installing the silencer is limited due to space limitations between the compressor of the supercharger and the air cooler.

The present invention was made in view of the above problem, and an object is to provide a noise reduction structure that can effectively reduce noise on an air discharge side of a compressor of a supercharger, and a supercharging device having the same.

Solution to the Problems (1) A noise reduction structure according to at least one embodiment of the present invention is a noise reduction structure for reducing noise on an air discharge side of a compressor of a supercharger, comprising: a compressor discharge-side pipe portion fuming at least part of a compressor discharge-side pipe, the compressor discharge-side pipe comprising a compressor outlet pipe disposed downstream from a tongue section of a scroll of the compressor and a pipe connecting the compressor outlet pipe to an air cooler; a first porous plate having a plurality of through holes and extending circumferentially along an inner circumferential surface of the compressor discharge-side pipe portion so that an air layer is formed between the first porous plate and the inner circumferential surface; a partition dividing an interior of the compressor discharge-side pipe portion in a radial direction or in a circumferential direction of the compressor discharge side pipe portion so as to form a plurality of flow paths in the compressor discharge-side pipe portion; and a second porous plate having a plurality of through holes, the second porous plate being provided in each of the plurality of flow paths and extending along the partition so that an air layer is formed between the second porous plate and the partition.

With the noise reduction structure described in the above (1), the first porous plate and the air layer function as an acoustic, filter, as well as the second porous plate and the air layer function as an acoustic filter, which make it possible to reduce noise that passes through the noise reduction structure.

Moreover, the provision of the partition and the second porous plate increases the installation area of, the porous plates, compared with the case where the compressor discharge-side pipe portion is provided with only the first porous plate. Thus, it is possible to increase the noise reduction effect per length unit of the compressor discharge-side pipe portion and thereby effectively reduce noise on an air discharge side of the compressor.

(2) In some embodiments, in the noise reduction structure described in the above (1), the partition comprises a plurality of partition plates extending in the radial direction so as to divide the interior of the compressor discharge-side pipe portion into the plurality of flow paths in the circumferential direction.

With the noise reduction structure described in the above (2), the second porous plates extend along both surfaces of the partition plates extending radially, which makes it possible to increase the noise reduction effect per length unit of the compressor discharge-side pipe portion, and thereby obtain a high noise reduction effect with a simple structure. Additionally, the noise reduction structure can be easily produced. For instance, the partition can be easily fixed to the compressor discharge-side pipe portion by inserting the partition into the compressor discharge-side pipe portion from one end of the compressor discharge-side pipe portion and then bonding radially outer edges of the partition plates to the inner circumferential surface of the compressor discharge-side pipe portion by means of welding or the like. Additionally, since the compressor discharge-side pipe portion is supported from inside by the plurality of partition plates which extend radially, high stiffness can be achieved.

(3) In some embodiments, in the noise reduction structure described in the above (2), the partition has a cross-shaped cross-sectional shape so as to divide the interior of the compressor discharge-side pipe portion into four flow paths in the circumferential direction.

With the noise reduction structure described in the above (3), the second porous plates extend along both surfaces of four partition plates which extend radially, so that eight second porous plates are provided in total which extend radially. Thus, it is possible to increase the noise reduction effect per length unit, of the compressor discharge-side pipe portion, and thereby obtain a high noise reduction effect with a simple structure.

(4) In some embodiments, in the noise reduction structure described in the above (2), the partition is configured to satisfy n1<n2, where, provided that plane S is a plane including a pipe central axis of the compressor discharge-side pipe portion and a straight line parallel to a rotational axis of an impeller of the compressor, n1 is the number of the partition plates that are disposed on a side of the rotational axis with respect to plane S; and n2 is the number of the partition plates that are disposed on a side opposite to the rotational axis with respect to plane S, from among N number of the plurality of partition plates.

In a flow rate at which air flows through the compressor outlet pipe and a portion close to the compressor outlet pipe of the compressor discharge-side pipe, an outer-circumferential side flow rate, which is apart from the rotational axis of the impeller of the compressor with respect to plane S, is higher than an inner-circumferential side flow rate, which is close to the rotational axis with respect to plane S. In this regard, with the noise reduction structure described in above (4), the number n1 of the partition plates disposed on a side of the rotational axis (inner-circumferential side) with respect to plane S is less than the number n2 of the partition plates disposed on a side opposite to the rotational axis (outer-circumferential side) with respect to plane S. This enables adjustment of the flow path resistance attributable to the second porous plates provided along the partition plates such that an inner-circumferential side flow path resistance is lower than an outer-circumferential side flow path resistance. Thus, a uniform flow rate distribution can be achieved in the flow path cross-section.

Consequently with the noise reduction structure described in the above (4), the increase in energy loss due to the flow path resistance attributable to the second porous plates can be controlled by the uniform flow rate distribution. Thus, the increase in energy loss can be controlled while reducing noise on the discharge side of the compressor.

(5) In some embodiments, in the noise reduction structure described in the above (1), the partition has a circular cross-sectional shape so as to divide the interior of the compressor discharge-side pipe portion into two flow paths in the radial direction.

With the noise reduction structure described in the above (5), tubular second porous plates are provided inside and outside the tubular partition in a concentric manner. Thus, it is possible to increase the noise reduction effect per length unit of the compressor discharge-side pipe portion, and thereby obtain a high noise reduction effect with a simple structure.

(6) In some embodiments, in the noise reduction structure described in any one of the above (1) to (5), the compressor discharge-side pipe portion comprises the compressor outlet pipe.

With the noise reduction structure described in the above (6), the first porous plate and the second porous plate are provided at the compressor outlet pipe, which is part of the supercharger, and thereby noise of the supercharger can be reduced regardless of the structure of the pipe connecting the compressor outlet pipe to the air cooler.

(7) In some embodiments, the noise reduction structure described in any one of the above (1) to (6) further comprises a third porous plate having a plurality of through holes and extending along an inner wall of the scroll so that an air layer is formed between the third porous plate and the inner wall.

With the noise reduction structure described in the above (7), the third porous plate is provided along the inner wall of the scroll of the supercharger, and thereby noise of the supercharger can be reduced regardless of the structure of the pipe connecting the compressor to the air cooler.

(8) A supercharging device according to at least one embodiment of the present invention comprises a supercharger and the noise reduction structures described in any one of the above (1) to (7).

The supercharging device described in the above (8) includes the noise reduction structure described in any one of the above (1) to (7), and thereby it is possible to effectively reduce noise on an air discharge side of the compressor.

Advantageous Effects

According to at least one embodiment of the present invention, there is provided a noise reduction structure that can effectively reduce noise on an air discharge side of a compressor of a supercharger, and a supercharging device having the same.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction" "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered comers within the range in which the same effect can be achieved.

On the other hand, an expression such as "comprise", "include", "have", "contain" and "constitute" are not intended to be exclusive of other components.

Figure 1:
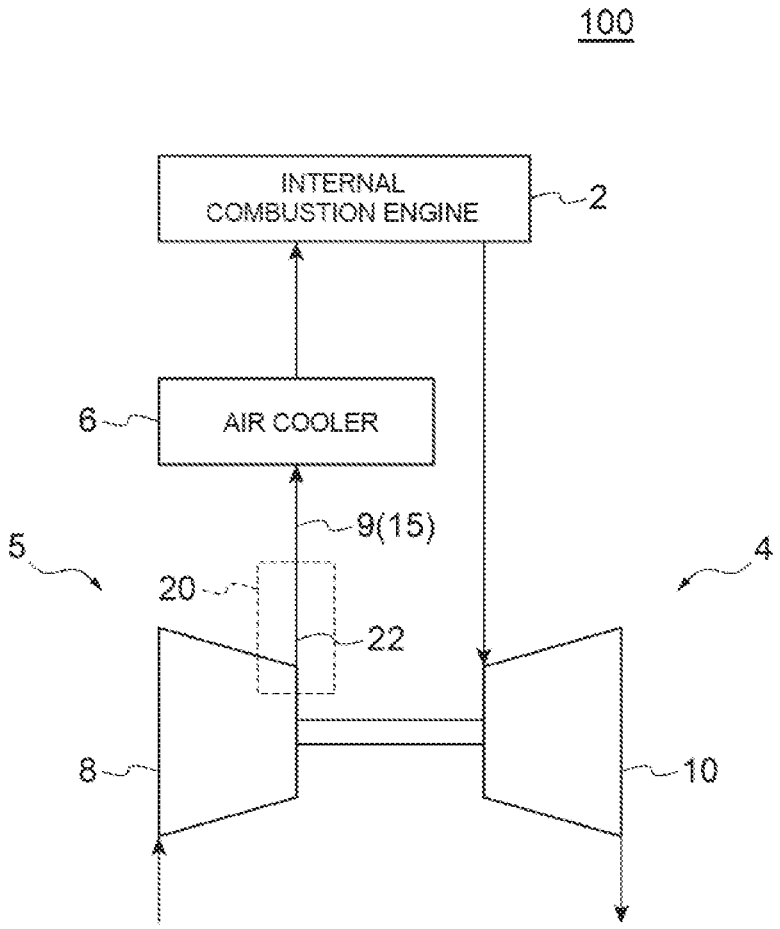
FIG. 1 is a block diagram illustrating a schematic, configuration of an internal combustion engine system 100 according to an embodiment.

FIG. 1 is a block diagram illustrating a schematic configuration of an internal combustion engine system 100 according to an embodiment.

As shown in FIG. 1, the internal combustion engine system 100 includes an internal combustion engine 2 (for example, a marine diesel engine), a supercharger 4, and an air cooler 6.

In the illustrated embodiment, the supercharger 4 is an exhaust turbine type supercharger (turbocharger). This supercharger 4 is configured such that a compressor 8 compresses air to be supplied to the internal combustion engine 2 by driving a turbine 10 connected coaxially with the compressor 8 using exhaust gas of the internal combustion engine 2. The air compressed by the compressor 8 is introduced to the air cooler 6 through a compressor discharge-side pipe 9, cooled by the air cooler 6 with increasing air density and then supplied to the internal combustion engine 2.

Figure 2:
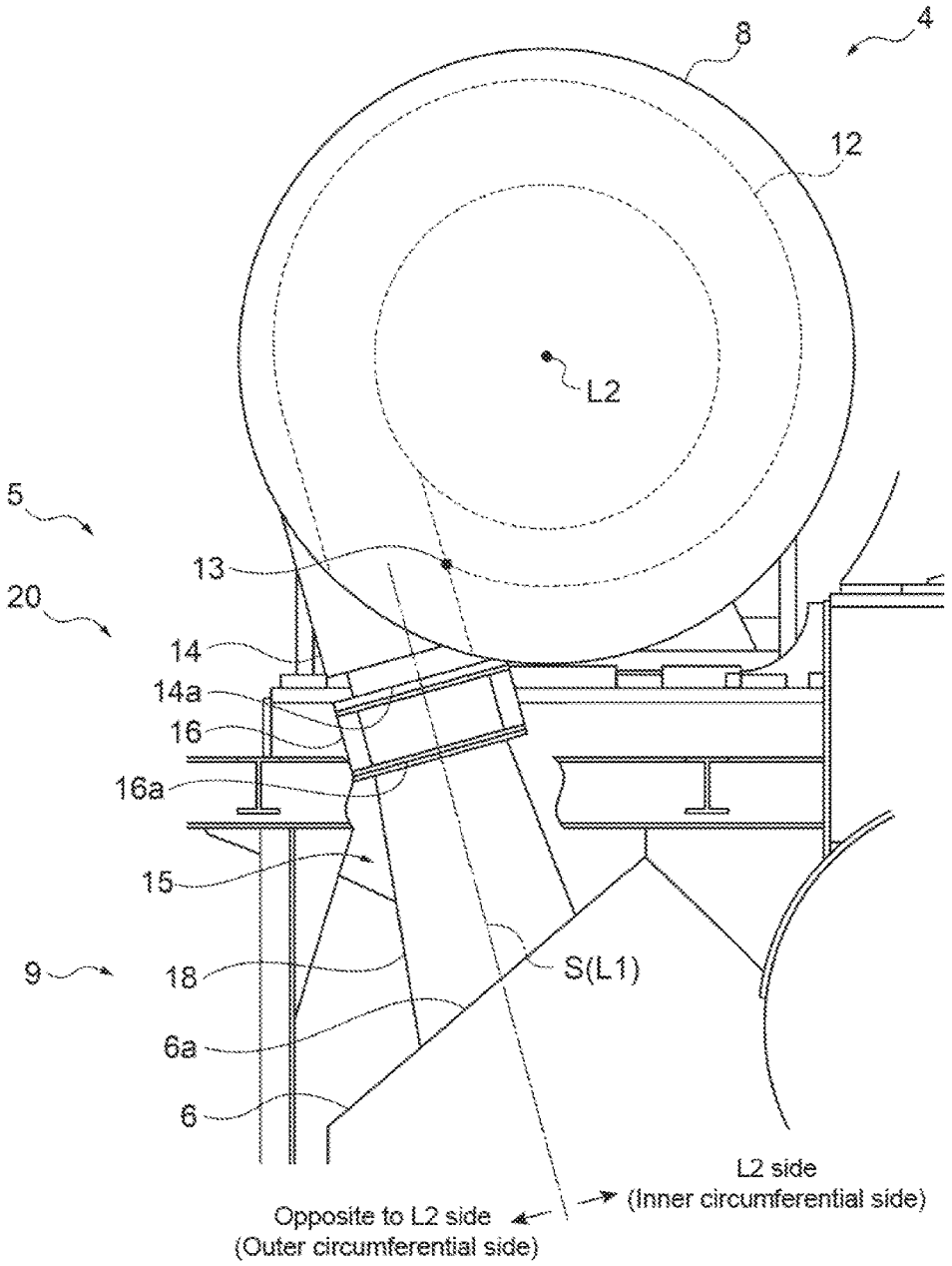
FIG. 2 is a diagram illustrating a configuration of a compressor discharge-side pipe 9 when viewing a compressor 8 from the axial direction.

FIG. 2 is a diagram illustrating a configuration of the compressor, discharge-side pipe 9, when viewing the compressor 8 from the axial direction.

As shown in FIG. 2, the compressor discharge-side pipe 9 includes a compressor outlet pipe 14 disposed downstream from a tongue section 13 of a scroll 12 (a junction between winding start and end of the scroll 12) of the compressor 8 and a pipe 15 connecting the compressor outlet pipe 14 to the air cooler 6. In the illustrated embodiment, the pipe 15 includes an expansion joint 16 connected to a downstream end 14*a* of the compressor outlet pipe 14 and a diameter-varied tube 18 connecting a downstream end 16*a* of the expansion joint 16 to an inlet 6*a* of the air cooler 6.

As shown in FIG. 1 and FIG. 2, the internal combustion engine system 100 includes a noise reduction structure 20 for reducing noise on an air discharge side of the compressor 8 of the supercharger 4. The noise reduction structure 20 and the supercharger 4 constitute a supercharging device 5.

Hereinafter, the noise reduction structure 20 (20A to 20D) according to some embodiments will be described with reference to FIGS. 3 to 6.

Figure 3:
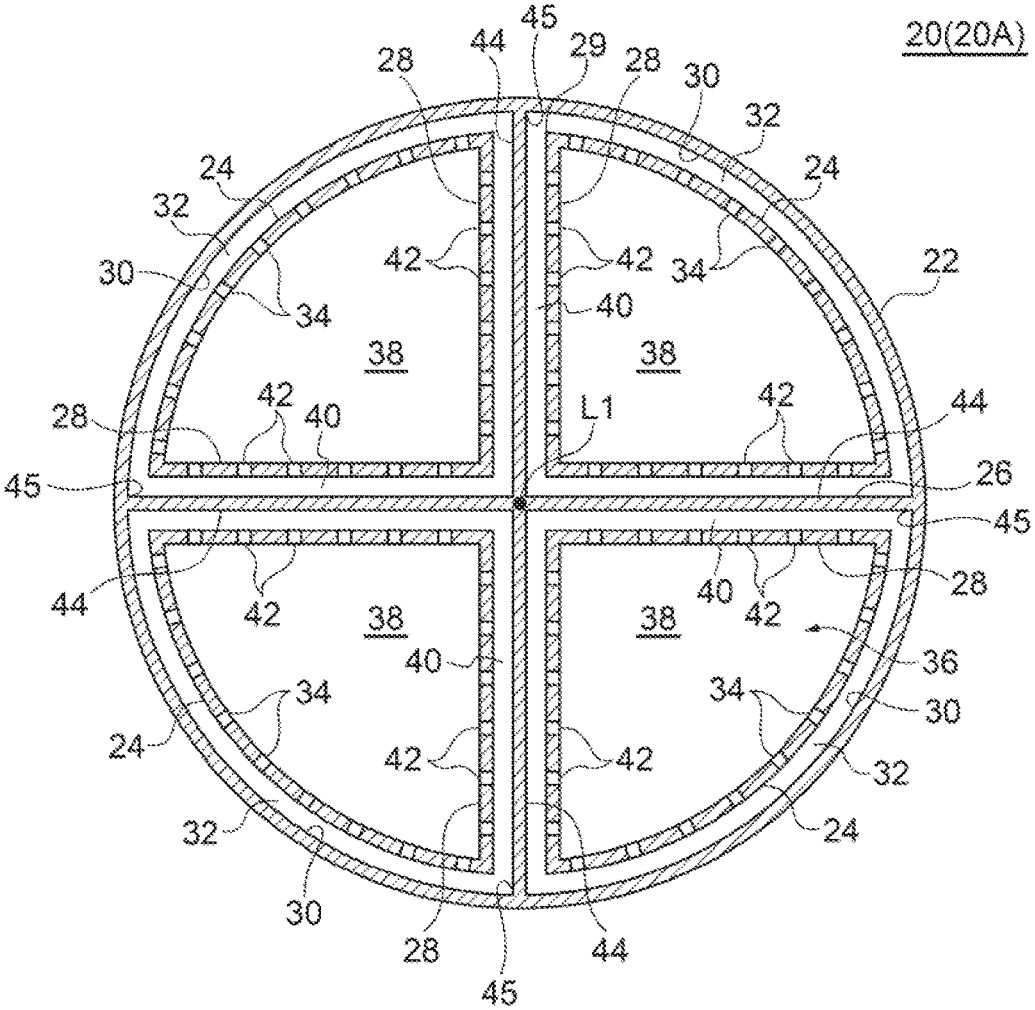
FIG. 3 is a schematic cross-sectional view of a noise reduction structure 20 (20A) according to an embodiment.
Figure 4:
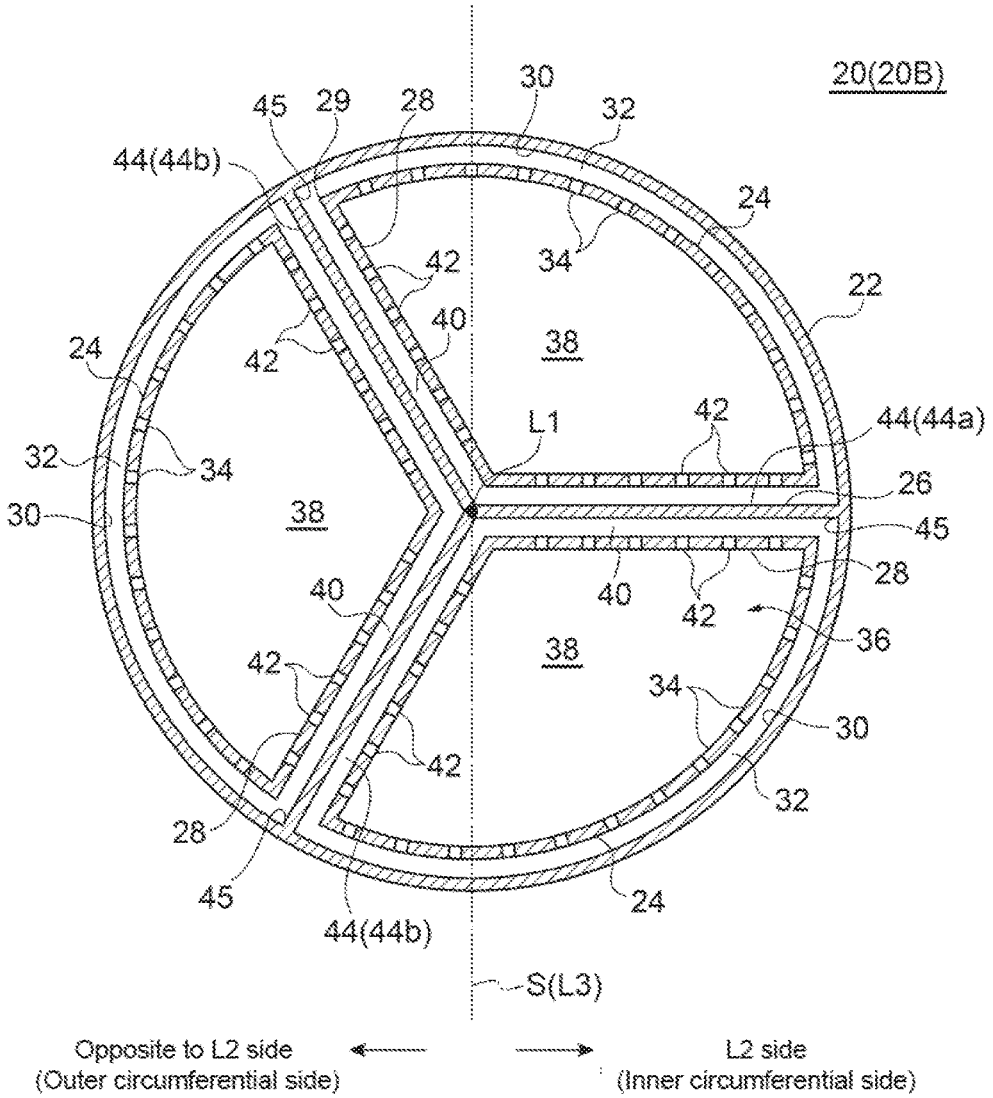
FIG. 4 is a schematic cross-sectional view of a noise reduction structure 20 (20B) according to an embodiment.
Figure 5:
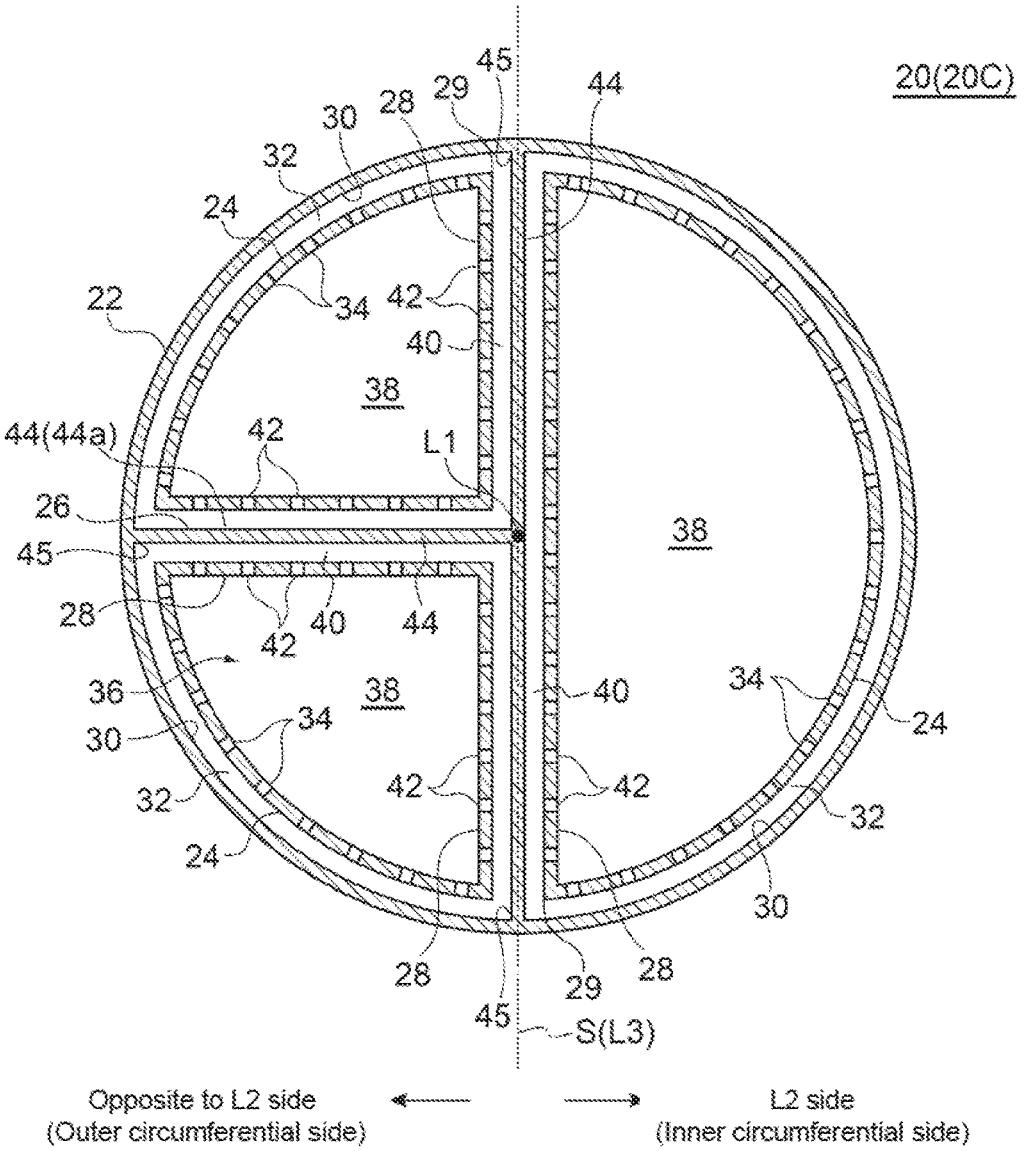
FIG. 5 is a schematic cross-sectional view of a noise reduction structure 20 (20C) according to an embodiment.
Figure 6:
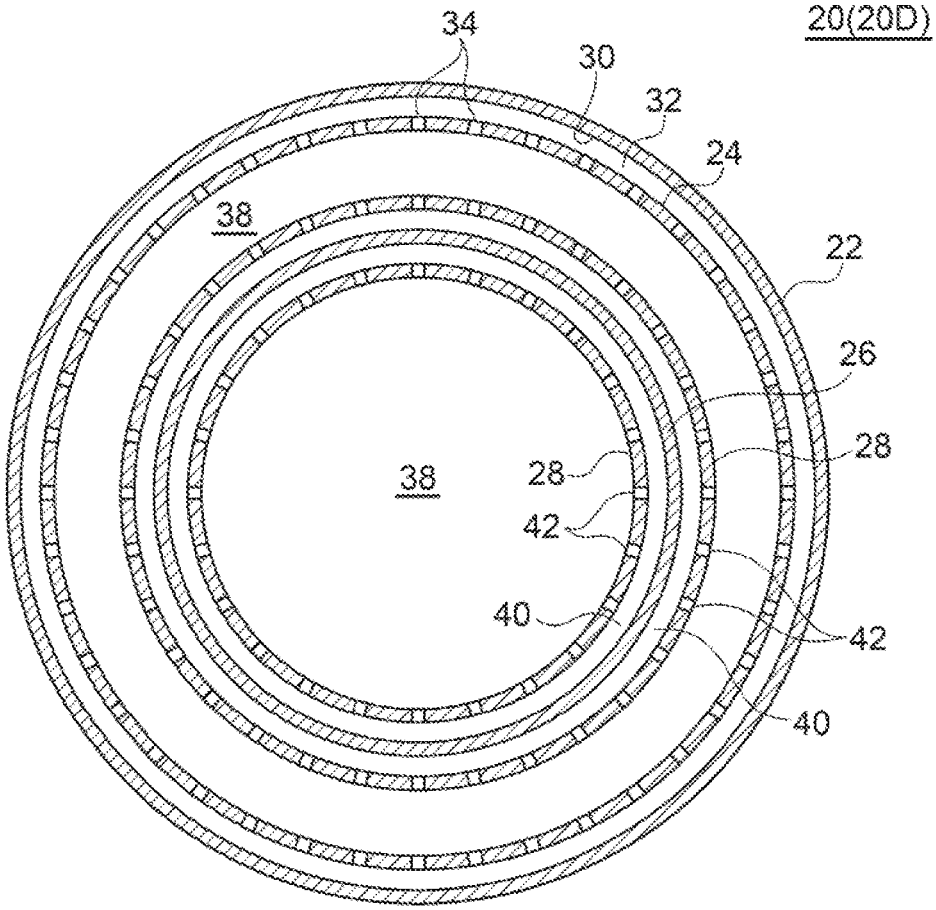
FIG. 6 is a schematic cross-sectional view of a noise reduction structure 20 (20D) according to an embodiment.

FIG. 3 is a schematic cross-sectional view of a noise reduction structure 20 (20A) according to an embodiment. FIG. 4 is a schematic cross-sectional view of a noise reduction structure 20 (20B) according to an embodiment. FIG. 5 is a schematic cross-sectional view of a noise reduction structure 20 (20C) according to an embodiment. FIG. 6 is a schematic cross-sectional view of a noise reduction structure 20 (20D) according to an embodiment.

In some embodiments, as shown in FIGS. 3 to 6, the noise reduction structure 20 (20A to 20D) includes a compressor discharge-side pipe portion 22 forming at least part of the compressor discharge-side pipe 9, a first porous plate(s) 24, a partition 26, and a second porous plate(s) 28. The compressor discharge-side pipe portion 22 means a portion of the compressor discharge-side pipe 9 which includes the first porous plate 24, the partition 26, and the second porous plate 28, as explained later.

The first porous plate 24 has a plurality of through holes 34 and extends circumferentially along an inner circumferential surface 30 of the compressor discharge-side pipe portion 22 so that an air layer 32 is formed between the first porous plate 24 and the inner circumferential surface 30 of the compressor discharge-side pipe portion 22. The partition 26 divides an interior 36 of the compressor discharge-side pipe portion 22 in a radial direction or in a circumferential direction of the compressor discharge-side pipe portion 22 so as to form a plurality of flow paths 38 in the compressor discharge-side pipe portion 22. The second porous plate 28 is provided in each of the flow paths 38. Each second porous plate 28 has a plurality of through holes 42 and extends along the partition 26 so that an air layer 40 is formed between the second porous plate 28 and the partition 26.

This configuration allows the first porous plate 24 and the air layer 32, as well as the second porous plate 28 and the air layer 40, to function as acoustic filters, thus reducing noise that passes through the noise reduction structure 20.

Figure 7:
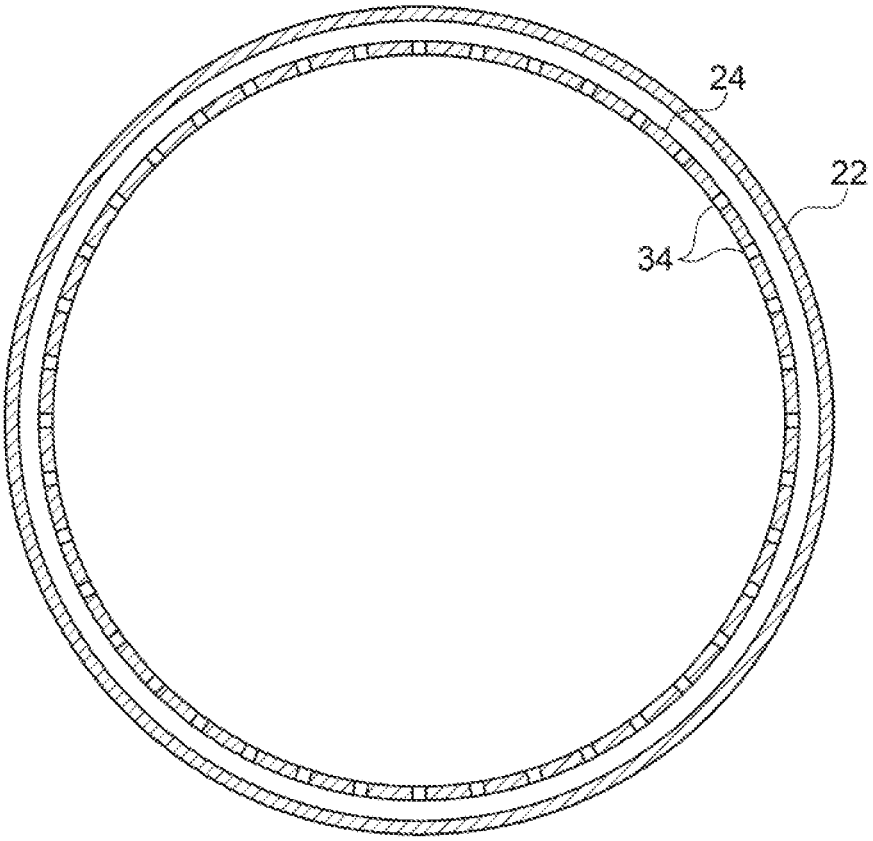
FIG. 7 is a schematic cross-sectional view of a noise reduction structure according to a comparative embodiment.

Additionally, the noise reduction structure 20 shown in FIGS. 3 to 6 can increase the installation area of the porous plates owing to the provision of the partition 26 and the second porous plate 28, compared with the case where the compressor discharge-side pipe portion 22 is provided with only the first porous plate 24 as shown in FIG. 7. Thus, it is possible to increase the noise reduction effect per length unit of the compressor discharge-side pipe portion 22.

Figure 8:
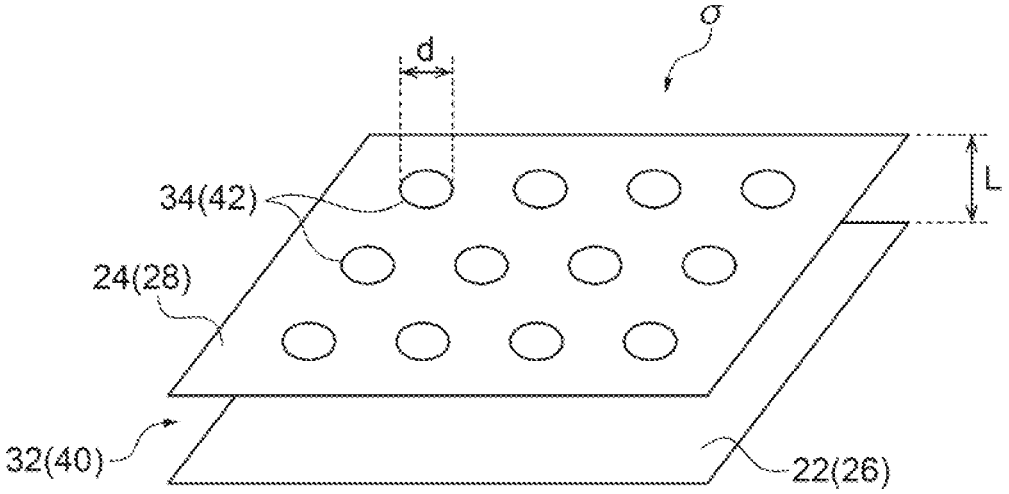
FIG. 8 is a schematic diagram illustrating a configuration of a first porous plate 24 and a second porous plate 28.

Referring to the first porous plate 24 and the second porous plate 28 in FIG. 8, pore size d and aperture ratio σ of the through holes 34 and the through holes 42, as well as thickness L of the air layer 32 and the air layer 40, may be adjusted in accordance with a resonance frequency corresponding to the rotational period of an impeller 11 (see FIG. 9) of the compressor 8. This adjustment enables noise of the impeller 11 of the compressor 8 to be effectively reduced.

In some embodiments, as shown in FIGS. 3 to 5, the partition 26 includes a plurality of partition plates 44 extending in the radial direction so as to divide the interior 36 of the compressor discharge-side pipe portion 22 into the plurality of flow paths 38 in the circumferential direction. In each of the flow paths 38, the fast porous plate 24 and the second porous plate(s) 28 are provided. Additionally, the second porous plates 28 extend in the radial direction along both surfaces of each partition plate 44, and radially outer edges 29 of the second porous plates 28 connect to the corresponding first porous plate 24.

This configuration allows the noise reduction structure 20 to be easily produced. For instance, the partition 26 can be easily fixed to the compressor discharge-side pipe portion 22 by inserting the partition 26 into the compressor discharge-side pipe portion 22 from one end of the compressor discharge-side pipe portion 22 and then bonding radially outer edges 45 of the partition plates 14 to the inner circumferential surface 30 of the compressor discharge-side pipe portion 22 by means of welding or the like. Additionally, since the compressor discharge-side pipe portion 22 is supported from inside by the plurality of partition plates 44 which extend radially, high stiffness can be achieved.

In one embodiment, as shown in FIG. 3, the partition 26 has a cross-shaped cross-sectional shape so as to divide the interior 36 of the compressor discharge-side pipe portion 22 into four flow paths 38 in the circumferential direction. In the illustrated embodiment, the second porous plates 28 extend along both surfaces of four partition plates 44 so that eight second porous plates 28 are provided in total. Thus, it is possible to increase the noise reduction effect per length unit of the compressor discharge-side pipe portion 22, and thereby obtain a high noise reduction effect with a simple structure.

In some embodiments, as shown in FIGS. 2, 4, and 5, the partition 26 is configured to satisfy n1=n2, where, provided that plane S is a plane including a pipe central axis LI of the compressor discharge-side pipe portion 22 and a straight line L3 parallel to a rotational axis L2 of the impeller 11 (see FIG. 9) of the compressor 8, n1 is the number of the partition plates 44 (44*a*) that are disposed on a side of the rotational axis L2 with respect to plane S and n2 is the number of the partition plates 44 (44*b*) that are disposed on a side opposite to the rotational axis L2 with respect to plane S, from among N number of the plurality of partition plates 44. In the embodiment shown in FIG. 4, N=3, n1=1, and n2=2 are satisfied; in the embodiment shown in FIG. 5, N=3, n1=1, and n2=0 are satisfied (provided that the number of the partition plates 44 that are disposed on plane S is not counted in n1 nor n2).

In a flow rate at which air flows through the compressor outlet pipe 14 and a portion close to the compressor outlet pipe 14 of the compressor discharge-side pipe 9, an outer-circumferential side flow rate, which is apart from the rotational axis L2 of the impeller 11 of the compressor 8 with respect to plane S, is higher than an inner-circumferential side flow rate, which is close to the rotational axis L2 with respect to plane S. In this regard, the configurations shown in FIGS. 4 and 5, in which the number n1 of the partition plates 44 (44*a*) disposed on a side of the rotational axis L2 (inner-circumferential side) with respect to plane S is less than the number n2 of the partition plates 44 (14*b*) disposed on a side opposite to the rotational axis L2 (outer-circumferential side) with respect to plane S, can adjust the flow path resistance attributable to the second porous plates 28 provided along the partition plates 44 such that an inner-circumferential side flow path resistance is lower than an outer-circumferential side flow path resistance. Thus, a uniform flow rate distribution can be achieved in the flow path cross-section.

Consequently, with the configurations shown in FIGS. 4 and 5, the increase in energy loss due to the flow path resistance attributable to the second porous plates 28 can be controlled by the uniform flow rate distribution. Thus, the increase in energy loss can be controlled while reducing noise on the discharge side of the compressor S.

In one embodiment, as shown in FIG. 6, the partition 26 has a circular cross-sectional shape so as to divide the interior 36 of the compressor discharge-side pipe portion 22 into two flow paths 38 in the radial direction. That is, in the embodiment shown in FIG. 6, a double pipe is formed by the compressor discharge-side pipe portion 22 and the partition 26. Additionally, a tubular second porous plate 28 (28*a*) is provided concentrically within the tubular partition 26, while an annular second porous plate 28 (28*b*) is provided concentrically outside the tubular partition 26. Thus, it is possible to increase the noise reduction effect per length unit of the compressor discharge-side pipe portion 22, and thereby obtain a high noise reduction effect with a simple structure.

The above-described noise reduction structure 20 (20A to 20D) may be applied to any of the compressor outlet pipe 14, the expansion joint 16, and the diameter-varied tube 18. In other words, the compressor discharge-side pipe portion 22 includes at least one of the compressor outlet pipe 14, the, expansion joint 16, and the diameter-varied tube 18. In a preferred practice, however, the noise reduction structure 20 (20A to 20D) is applied to the compressor outlet pipe 14 (i.e., the compressor discharge-side pipe portion 22 includes the compressor outlet pipe 14), since noise of the supercharger 4 can be reduced regardless of the structure of the pipe 15 connecting the compressor 8 to the air cooler 6. Additionally, when the noise reduction structure 20 (20B or 20C) is applied to the compressor outlet pipe 14 (i.e., the compressor discharge-side pipe portion 22 shown in FIG. 4 or FIG. 5 includes the compressor outlet pipe 14), a uniform flow rate distribution can be achieved in the flow path cross-section of the compressor outlet pipe 14 as described above, and thus the increase in energy loss can be controlled while reducing noise on the discharge side of the compressor 8.

Figure 9:
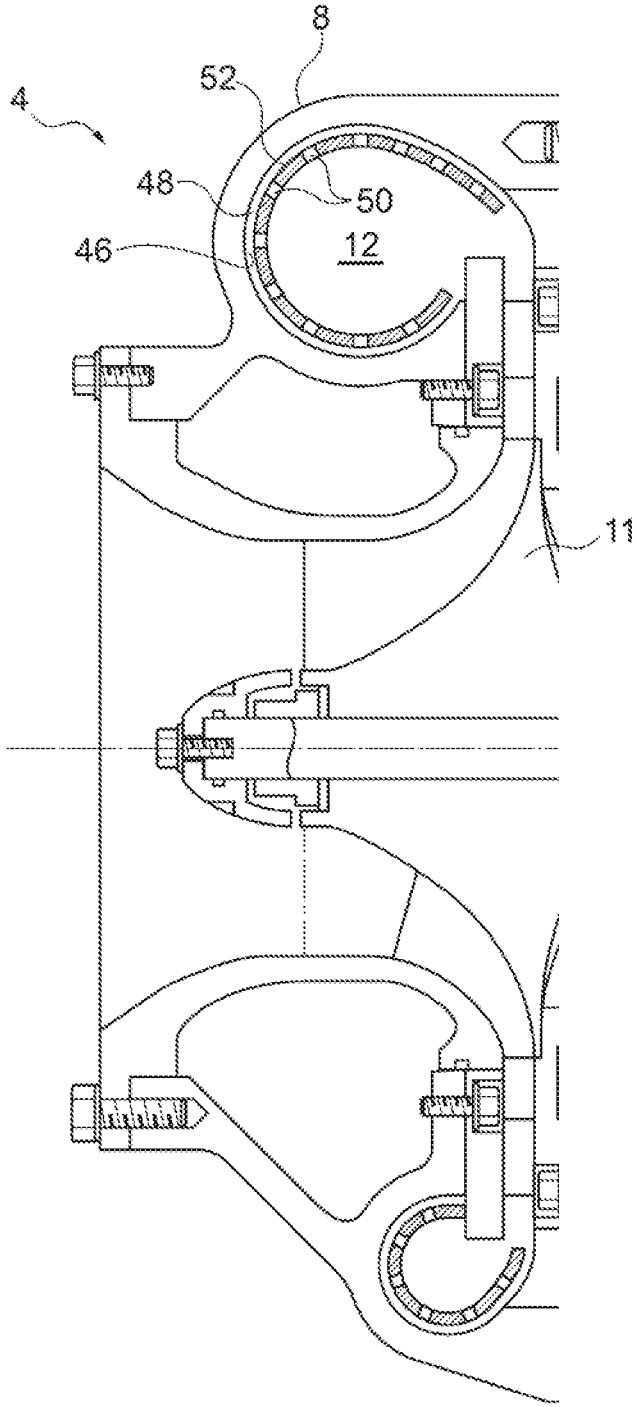
FIG. 9 is a schematic cross-sectional view of a compressor 8 of a supercharger 4 according to an embodiment which illustrates a noise reduction structure 20 (20E) according to an embodiment.

FIG. 9 is a schematic cross-sectional view of a compressor 8 of a supercharger 4 according to an embodiment which illustrates a noise reduction structure 20 (20E) according to an embodiment.

In one embodiment, as shown in. FIG. 9, the noise reduction structure 20 (20E) includes a third porous plate 52. In the embodiment shown in FIG. 9, the third porous plate 52 has a plurality of through holes 50 and extends along an inner wall 46 of the scroll 12 so that an air layer 48 is formed between the third porous plate 52 and the inner wall 46. In the illustrated embodiment, the third porous plate 52 extends along the inner wall 46 over half or more the circumference of the scroll 12.

This configuration allows the third porous plate 52 and the air layer 48 to also function as an acoustic filter, thus reducing noise on the discharge side of the compressor 8. Additionally noise of the supercharger 4 can be reduced regardless of the structure of the pipe 15 connecting the compressor 8 to the air cooler 6.

Embodiments of the present invention were described in detail, above, but the present invention is not limited thereto, and various amendments and modifications may be implemented.

For instance, any one of the noise reduction structures 20 (20A to 20D) shown in FIGS. 3 to 6 and the noise reduction structure 20 (20E) shown in FIG. 9 may be used alone or in combination. In other words, the above-described supercharging device 5 may include either any one of the noise reduction structures 20 (20A to 20D) shown in FIGS. 3 to 6 or the noise reduction structure 20 (20E) shown in FIG. 9, or may include both of them.

Additionally, the compressor discharge-side pipe 9 may apply one of the noise reduction structures 20 (20A to 20D), or may apply two or more thereof. For instance, the noise reduction structure 20 (20A) shown in. FIG. 3 may be applied to the compressor outlet pipe 14, while the noise reduction structure 20 (20D) may be applied to at least part of the pipe 15. Of course, any other combination is possible.

Although the above exemplary embodiments are discussed in conjunction with an exhaust turbine type supercharger (turbocharger), the supercharger is not limited thereto, and may be a mechanical supercharger for driving a compressor with electric motor power or with power extracted from an output shaft of an internal combustion engine via a belt or the like.

REFERENCE SIGNS LIST

2 Internal combustion engine
4 Supercharger
5 Supercharging device
6 Air cooler
  6*a* Inlet
8 Compressor
9 Compressor discharge-side pipe
10 Turbine
11 Impeller
12 Scroll
13 Tongue section
14 Compressor outlet pipe
  14*a* Downstream end

15 Pipe
16 Expansion joint
16*a* Downstream end
18 Diameter-varied tube
20 (70A, 20B, 20C, 20D) Noise reduction structure
22 Compressor discharge-side pipe portion
24 First porous plate
26 Partition
28 Second porous plate
29 Outer edge
30 Inner circumferential surface
32 Air layer
34 Through hole
36 Interior
38 Flow path
40 Air layer
42 Through hole
44 (44*a*, 44*b*) Partition plate
45 Outer edge
46 inner wall
48 Air layer
50 Through hole
52 Third porous plate
100 Internal combustion engine system
L1 Pipe central axis
L2 Rotational axis
L3 Straight line
N, n1, n2 Number
S Plane

The invention claimed is:

1. A noise reduction structure for reducing noise on an air discharge side of a compressor of a supercharger, comprising:

a compressor discharge-side pipe portion forming at least part of a compressor discharge-side pipe, the compressor discharge-side pipe comprising a compressor outlet pipe disposed downstream from a tongue section of a scroll of the compressor and a pipe connecting the compressor outlet pipe to an air cooler;

a first porous plate having a plurality of through holes and extending circumferentially along an inner circumferential surface of the compressor discharge-side pipe portion so that an air layer is formed between the first porous plate and the inner circumferential surface:

a partition dividing an interior of the compressor discharge-side pipe portion in a radial direction or in a circumferential direction of the compressor discharge-side pipe portion so as to form a plurality of flow paths in the compressor discharge-side pipe portion; and a second porous plate having a plurality of through holes, the second porous plate being provided in each of the plurality of flow paths and extending along the partition so that an air layer is formed between the second porous plate and the partition.

2. The noise reduction structure according to claim 1, wherein the partition comprises a plurality of partition plates extending in the radial direction so as to divide the interior of the compressor discharge-side pipe portion into the plurality of flow paths in the circumferential direction.

3. The noise reduction structure according to claim 2, wherein the partition has a cross-shaped cross-sectional shape so as to divide the interior of the compressor discharge-side pipe portion into four flow paths in the circumferential direction.

4. The noise reduction structure according to claim 2, wherein the partition is configured to satisfy $n1<2n2$, where, provided that plane S is a plane including a pipe central axis of the compressor discharge-side pipe portion and a straight line parallel to a rotational axis of an impeller of the compressor, n1 is the number of the partition plates that are disposed on a side of the rotational axis with respect to plane S; and n2 is the number of the partition plates that are disposed on a side opposite to the rotational axis with respect to plane S, from among N number of the plurality of partition plates.

5. The noise reduction structure according to claim 1, wherein the partition has a circular cross-sectional shape so as to divide the interior of the compressor discharge-side pipe portion into two flow paths in the radial direction.

6. The noise reduction structure according to claim 1, wherein the compressor discharge-side pipe portion comprises the compressor outlet pipe.

7. The noise reduction structure according to claim 1, further comprising:

a third porous plate having a plurality of through holes and extending along an inner wail of the scroll so that an air layer is formed between the third porous plate and the inner wall.

8. A supercharging device comprising a supercharger and a noise reduction structure according to claim 1.

* * * * *